US006638471B1

(12) United States Patent
Wagener et al.

(10) Patent No.: US 6,638,471 B1
(45) Date of Patent: Oct. 28, 2003

(54) WATER COOLED VESSEL FOR VACUUM PROCESSING LIQUID STEEL

(75) Inventors: F. Wagener, Duisburg (DE); Arno Luven, Krefeld (DE)

(73) Assignee: Technometal Gesellschaft für Metalltechnologie mbH (DE)

( * ) Notice: Subject to any disclaimer, the term of this patent is extended or adjusted under 35 U.S.C. 154(b) by 0 days.

(21) Appl. No.: 09/700,900

(22) PCT Filed: May 17, 1999

(86) PCT No.: PCT/DE99/01472

§ 371 (c)(1),
(2), (4) Date: Mar. 5, 2001

(87) PCT Pub. No.: WO99/60174

PCT Pub. Date: Nov. 25, 1999

(30) Foreign Application Priority Data

May 16, 1998 (DE) ..... 198 22 159

(51) Int. Cl.[7] ..... C21C 7/10
(52) U.S. Cl. ..... 266/144; 266/208; 266/241
(58) Field of Search ..... 266/208, 209, 266/210, 241, 144, 146

(56) References Cited

U.S. PATENT DOCUMENTS 3,565,411 A * 2/1971 Grossmann ..... 266/241
5,299,784 A * 4/1994 Scholer et al. ..... 266/210
5,520,373 A * 5/1996 Keilman et al. ..... 266/209

FOREIGN PATENT DOCUMENTS

DE 4130590 A1 3/1993

OTHER PUBLICATIONS

Wagener F et al, "Future development in secondary steelmaking", Steel Times International, Sep. 1998, XP–000790090.

Patent Abstracts of Japan, No. 04103713 dated Apr. 6, 1992.

* cited by examiner

*Primary Examiner*—Scott Kastler
(74) *Attorney, Agent, or Firm*—R W Becker & Associates; R W Becker

(57) ABSTRACT

The invention relates to a process vessel for vacuum processing liquid steel, comprising a lower part, a middle part and an upper part, and submersible pipes located on the lower part, whereby the process vessel is provided with a heating apparatus, a feed device, and a waste gas connection arranged at a right angle to the central axis of the vessel, and whereby the process vessel has an outer metal jacket and a refractory lining arranged at least in part in the interior of the vessel, according to which the metal jacket (19) of the upper part (15) of the vessel, including the waste gas connection (16), is provided with a water-cooling device (23) and is exposed directly on the interior side to the process conditions prevailing in the interior of the vessel (10).

8 Claims, 2 Drawing Sheets

WATER COOLED VESSEL FOR VACUUM PROCESSING LIQUID STEEL

BACKGROUND OF INVENTION

The present invention relates to a process vessel for vacuum processing liquid steel comprising a lower part that has submersible pipes located thereon and an upper part, furthermore having a heating apparatus, a feed device, and a waste gas connection arranged at a right angle to the central axis of the vessel, whereby the process vessel has an outer metal jacket and a refractory lining arranged in the interior of the lower part of the vessel, and whereby the metal jacket of the upper part of the vessel, including the waste gas connection, is provided with a water-cooling device and is exposed directly on the interior side to the process conditions prevailing in the interior of the vessel.

JP-A-04 103 713 describes a steel process vessel with the aforesaid features; such a process vessel is used for secondary treatment, e.g. degassing liquid steel, in that the vessel's submersible pipes located on the lower part are lowered into a pan filled with liquid steel and the liquid steel is suctioned into the process vessel under a vacuum and, after the process phase, is returned to the pan. Provided in the cylindrical middle part of the vessel are connecting branches arranged on an incline for introducing alloy materials and for connecting a burner/heating device.

When very high temperatures occur in the process vessels, these process vessels are provided with a refractory lining at least in their lower part. With regard to the upper part, JP-A-04 103 713, which describes the generic process vessel, suggests providing its metal jacket with a water-cooling device and exposing it directly on the interior side to the process conditions prevailing in the interior of the vessel.

These process vessels also involve the problem of sufficiently cooling the waste gases, and for this purpose a gas cooler is attached to the vessel downstream, which is not addressed in the generic JP-A-04 103 713 and which requires corresponding complexity in terms of construction. The object of the invention is therefore to provide the necessary cooling of the waste gases with the least possible complexity in terms of construction in a process vessel with the aforementioned features.

SUMMARY OF THE INVENTION

The realization of this object can be seen from claim 1; advantageous embodiments and further developments of the invention are provided in the subordinate claims.

For this purpose the invention provides that the metal jacket provided with the water-cooling device extends across the waste gas connection and forms a gas cooling segment connected to the waste gas connection of the vessel.

For improving the transfer of heat from the interior of the vessel to the water-cooling of the metal jacket, in accordance with one exemplary embodiment of the invention it can be provided that the metal jacket designed for water cooling has at its surface on the interior of the vessel a coating made from a material with high heat conductivity, whereby the coating preferably comprises copper. This is associated with the advantage of preventing the formation of skull on the water-cooled jacket region, since skull that forms is caused by its own low weight to separate from the walls of the vessel and to fall into the interior of the vessel due to heat elimination that has a shock-type effect. Depending on the exemplary embodiment of the invention, the upper part or even also the middle part can have such a coating.

In its simplest form in terms of the design of the water cooling, it can be provided that the metal jacket has two walls in the region designed for water cooling and is provided with connections for supplying cooling water and for eliminating heated water.

In an alternative embodiment the vessel jacket comprises a vertically-running pipe-to-pipe construction in its region designed for water cooling, whereby the, e.g. round or square, pipes form the intermediate space for conducting the cooling water.

In order to ensure a sufficient connection of the metal jacket provided with water cooling to the region of the vessel provided with a refractory lining, it can be provided that the metal jacket designed for water cooling is provided, at its flange connection to the vessel part having a refractory lining, on the inner side with insulation made of a refractory material that extends across a limited transition region. The insulation arranged in the transition region on the metal jacket designed for water cooling can be thinner than the lining of the adjacent vessel part.

In order to ensure smooth lining of the flange region that is at risk in such an embodiment of the invention, it can be provided that the jacket designed for water cooling, at its flange connection to the vessel part having a refractory lining, is arranged offset to the interior of the vessel by the difference in thickness between the insulation and the lining.

BRIEF DESCRIPTION OF THE DRAWINGS

The drawings present exemplary embodiments of the invention that are described in the following. Specifically.

DESCRIPTION OF PREFERRED EMBODIMENTS

Figure 2:
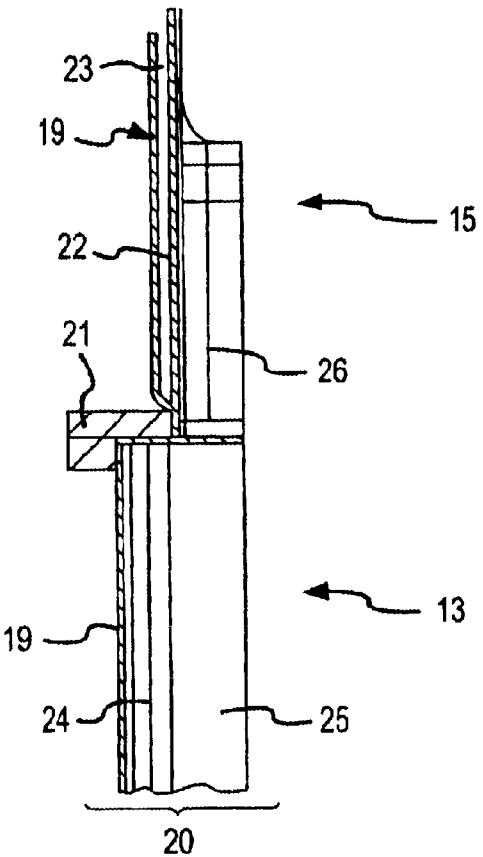
FIG. 2 is a sectional illustration of the transition between the water-cooled upper part and the middle part of the process vessel in accordance with FIG. 1 that is provided with a refractory lining.
Figure 1:
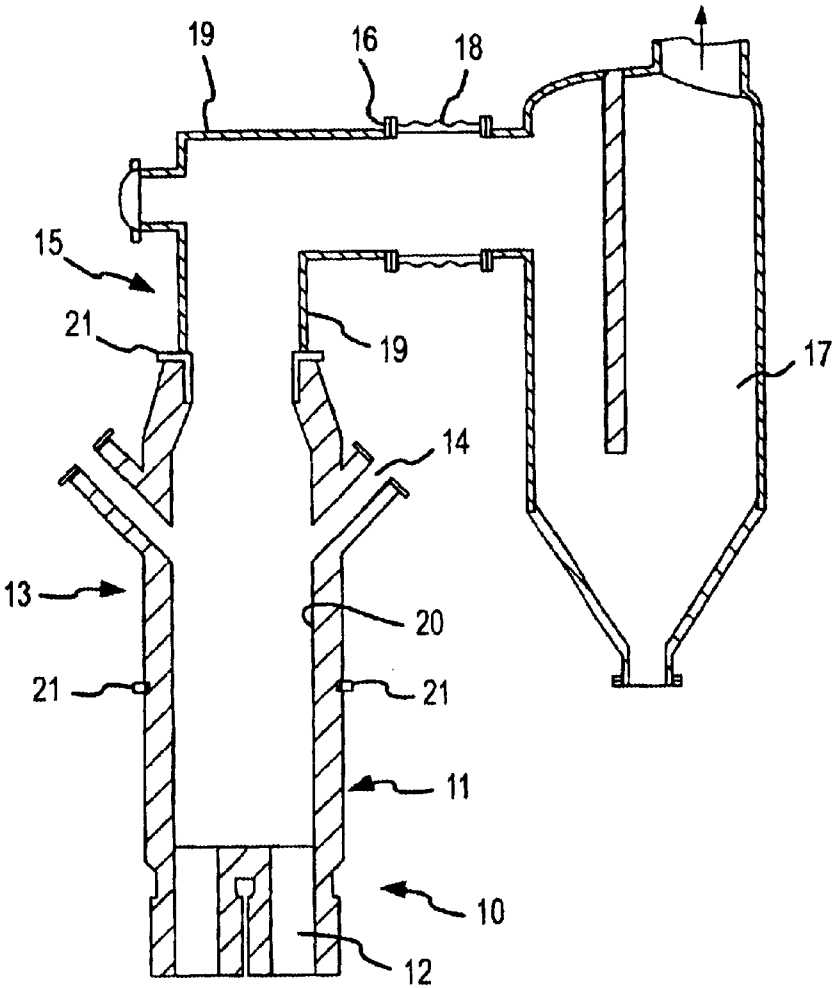
FIG. 1 illustrates a steel process vessel known from prior art with a water-cooled upper part.
Figure 3:
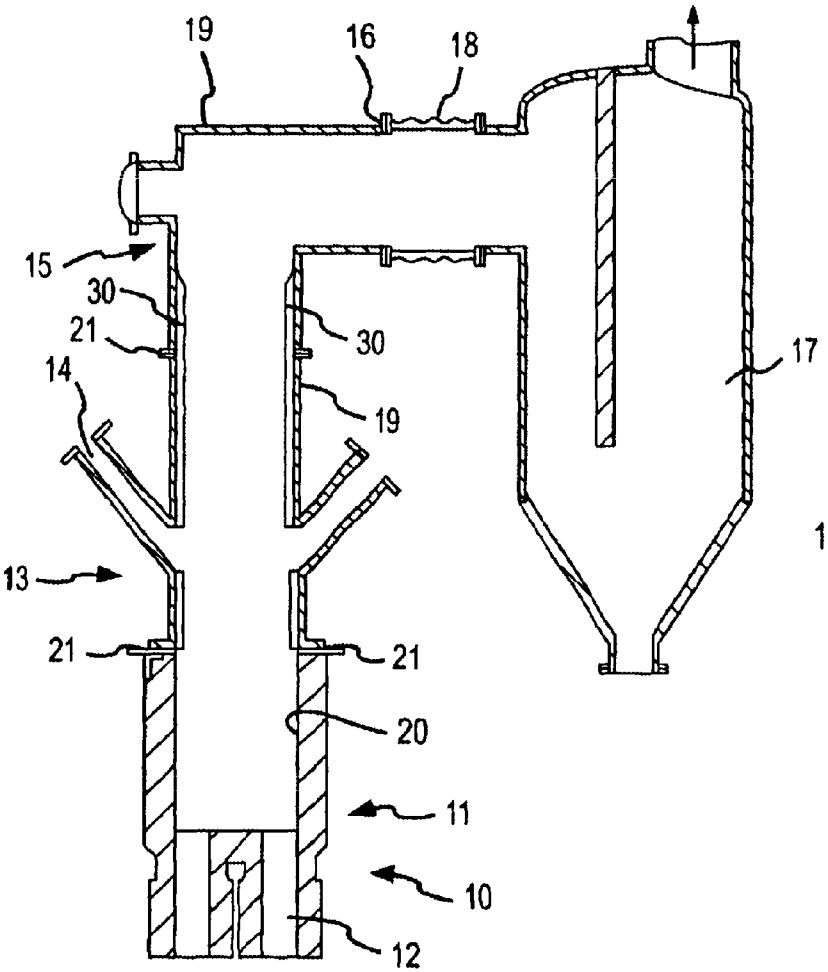
FIG. 3 illustrates another exemplary embodiment of a steel process vessel known from prior art with an upper part and a middle part provided with water-cooled walls.

The exemplary embodiments of the process vessel illustrated in FIGS. 1 through 3 are not included in the inventive idea and are therefore explained in the following in order to provide a better understanding of the subject matter of the invention.

The process vessel 10 schematically illustrated in FIG. 1 comprises a lower part 11 with submersible pipes 12 attached thereto, a middle part 13 that is located thereabove by means of a flange connector 21 and that has feed devices 14, and an upper part 15 that has, arranged at a right angle to the central axis of the process vessel 10, a waste gas connection 16, to which a gas cooler 17 is attached in the illustrated exemplary embodiment. An expansion joint 18 is interposed between the waste gas connection 16 and gas cooler 17. The entire vessel has an outer metal jacket 19, the lower part 11 and the middle part 13 of the process vessel 10 having a refractory lining 20 arranged in the interior of the vessel. As shown in FIG. 1, the upper part 15 is embodied with only the metal jacket 19, which is provided with a water-cooling device as shown in FIG. 2.

As can be seen in detail in FIG. 2, the vessel jacket for the upper part 15 is embodied with two walls, the outer metal jacket 19 and an inner metal jacket 22, which together form an intermediate space 23 for conducting cooling water. In order to provide protection in the region of the flange connector 21 and the region of the water cooling adjacent thereto, the region of the metal jacket 19 adjacent to the flange connector 21 is provided with internal insulation 26 in a transition area. Since this insulation 26 is not as thick as the entire lining 20 of the adjacent middle part 13 of the process vessel 10, the upper part 15 is arranged offset to the interior of the vessel by an amount equal to the difference between the thickness of the insulation 26 and the thickness of the refractory lining 20. As can be seen in detail in FIG. 2, the lining 20 comprises an outer lining 24 applied to the metal jacket 19 of the middle part 13, this outer lining connecting to the inside of the working lining 25. In contrast, the insulation 26 of the upper part 15 has the same structure as the outer lining 24 of the lower part 11.

In the exemplary embodiment illustrated in FIG. 3, not only does the upper part 15 have a metal jacket 19 with water cooling, but the middle part 13 does, as well, down to its flange connector 21 for connecting to the lower part 11, which itself is provided with a refractory lining 20. In addition, in this exemplary embodiment a coating 30 made of copper in the region of the middle part 13 is affixed to the surface of the middle part 13 in the interior of the vessel and to the upper part 15 and contributes to preventing skull from adhering due to the heat elimination from the vessel transition to the water cooling of the metal jacket 19, which has a shock-type effect.

Figure 4:
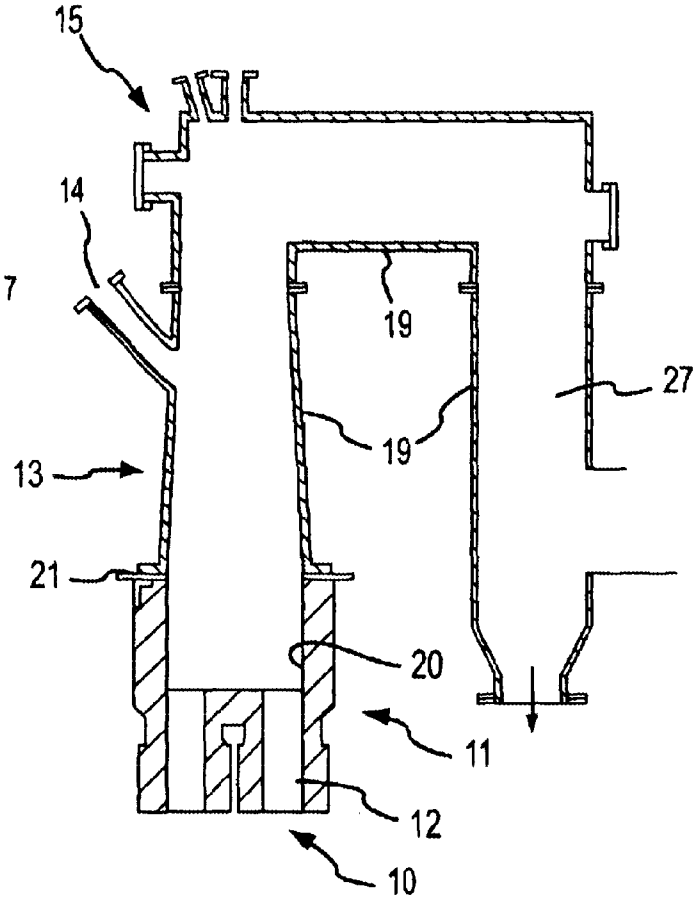
FIG. 4 illustrates the process vessel embodied in accordance with the invention with a gas cooling segment connected to the waste gas connection.

FIG. 4 illustrates that in a device in which the middle part 13 and the upper part 15 have a water-cooled jacket 19, the waste gas temperature can be caused to drop far enough that a conventional gas cooler is not necessary in that connected to the upper part 15 is a gas cooling segment 27 that is also provided with a water-cooled metal jacket 19 of the same design as for the middle part 13 and the upper part 15.

The specification incorporates by reference the disclosure of German priority document 198 22 159.2 of May 16, 1998 and PCT/DE99/01472 of May 17,1999.

The present invention is, of course, in no way restricted to the specific disclosure of the specification and drawings, but also encompasses any modifications within the scope of the appended claims.

What we claim is:

1. A process vessel for vacuum processing liquid steel, comprising:

a lower part having submersible pipes disposed thereon, wherein said lower part is provided on its interior with a refractory lining;

an upper part that communicates with said lower part;

a feed mechanism into said vessel;

a heating apparatus for said vessel;

a waste gas connection communicating with said upper part and disposed at a right angle to a central axis of said vessel;

an outer metal jacket disposed on said upper part and said waste gas connection such that it is exposed on an inner side directly to process conditions prevailing in the interior of said vessel;

a water cooling device for said metal jacket; and a separate gas cooling segment connected to said waste gas connection, wherein said metal jacket, with said water cooling device, extends beyond said waste gas connection to form said gas cooling segment.

2. A process vessel according to claim 1, wherein a surface of said metal jacket that faces the interior of said vessel is provided with a coating made of a material having a high heat conductivity.

3. A process vessel according to claim 2, wherein said coating comprises copper.

4. A process vessel according to claim 1, wherein said metal jacket, in a region designed for water cooling, has a double-walled construction and is provided with connections for supplying cooling water and for discharge of heated water.

5. A process vessel according to claim 1, wherein said metal jacket, in a region designed for water cooling, is provided with individual pipes that are disposed adjacent to one another for conducting cooling water.

6. A process vessel according to claim 1, wherein in the region where said upper part is connected to said refractory lined lower part, said metal jacked is provided on an inner side thereof with insulation that is made of refractory material and extends across a limited transition area.

7. A process vessel according to claim 6, wherein in said transition area said insulation of said metal jacket is thinner than said refractory lining of said lower part.

8. A process vessel according to claim 7, wherein said metal jacket, where said upper part is connected to said lower part, is offset relative to the interior of said vessel by the difference in thickness between said insulation and said refractory lining.

* * * * *

UNITED STATES PATENT AND TRADEMARK OFFICE

CERTIFICATE OF CORRECTION

PATENT NO. : 6,638,471 B1
DATED : October 28, 2003
INVENTOR(S) : Wagener et al.

It is certified that error appears in the above-identified patent and that said Letters Patent is hereby corrected as shown below:

Title page,
Item [75], should read as follows:
-- [75] Inventors: Friedhelm Wagener, Duisurg (DE); Arno Luven, Krefeld (DE) --.

Signed and Sealed this

Twenty-seventh Day of January, 2004

JON W. DUDAS
*Acting Director of the United States Patent and Trademark Office*